United States Patent [19]

Smith

[11] 4,165,778

[45] Aug. 28, 1979

[54] FLEXIBLE STRIP DOORS

[76] Inventor: John Smith, c/o Ivor M. Hughes, Suite 604, 1110 Finch Ave. West, Downsview, Ontario, Canada

[21] Appl. No.: 903,045

[22] Filed: May 5, 1978

[51] Int. Cl.[2] ..... E06B 9/20

[52] U.S. Cl. ..... 160/332; 15/97 B

[58] Field of Search ..... 160/189, 332, 330; 15/DIG. 2, 97 B

[56] References Cited

U.S. PATENT DOCUMENTS

| | | | |
|---|---|---|---|
| 3,249,150 | 5/1966 | Knight | 160/332 |
| 3,809,144 | 5/1974 | Garufo | 160/184 |
| 3,940,821 | 3/1976 | Moran | 15/DIG. 2 |

*Primary Examiner*—Peter M. Caun

*Attorney, Agent, or Firm*—Ivor M. Hughes

[57] ABSTRACT

A flexible strip door comprising a plurality of relatively long transparent sheets of heavy gauge plastics material of relatively narrow width as compared to their length, hung in overlapping fashion to close the exit of a car wash, the sheets alternatively displaying concave and convex surfaces to the interior of the car wash, and soft non-abrasive material secured by gluing or sewing to the inwardly facing concave and convex surfaces from a position intermediate the ends of the sheets to a position below the lowermost edge of each sheet to permit viewing of the driver of a vehicle passing through the car wash through the sheets, but prevent marring the finish to the vehicle passing through.

3 Claims, 7 Drawing Figures

FLEXIBLE STRIP DOORS

FIELD OF INVENTION

This invention relates to flexible strip doors.

BACKGROUND OF THE INVENTION

Winter creates severe problems for car wash owners. If the car washing equipment is not kept above the freezing temperature of water, the water in the nozzles of the equipment freezes. However, the maintenance of the equipment so that the water will not freeze, is a very costly proposition. Car washes are usually open at both ends, and the air heated by installed heaters, escapes out the open ends. As a result, on cold days, the heaters run continuously, at a substantial cost to the war wash operator.

It is therefore an object of this invention to provide a closure for such car wash, penetrable by cars passing through the car wash, which closure reduces the cost of heating.

It is a further object of the invention to provide such closure which does not damage the finish of the vehicles using the car wash facilities.

Further and other objects of the invention will be realized by those skilled in the art from the following summary of the invention and detailed description of the preferred embodiment thereof.

SUMMARY OF THE INVENTION

According to one aspect of the invention, a plurality of long, transparent sheets of heavy gauge plastics material of relatively narrow width as compared to their length are hung in overlapping fashion, at for example, the exit of the car wash to substantially close the car wash exit. Since each sheet has a natural curl therein, running across the width of each sheet, one side presents a concave outer surface and the other a convex outer surface. Consequently, when the sheets are hung, they are hung so that alternating convex and concave surfaces in adjacent sheets face inwardly;

According to another aspect of the invention, a soft non-abrasive material (for example, felt or carpet) is secured (as for example by gluing or sewing) to the surface of each sheet facing inwardly into the car wash, extending from the bottom of each sheet a sufficient length upwardly so that when a car penetrates the flexible strip door, it is engaged by the soft non-abrasive material and not by the plastics material. In this regard, the soft non-abrasive material extends below the lower edge of the plastic sheet;

According to another aspect of the invention, since the plastic material curls naturally, the soft non-abrasive material may be cut into strips of narrower and wider widths than the plastics sheets when flattened, and may be applied to the concave or convex surfaces respectively of the naturally curled sheets so as to reduce the stress in the joint formed as compared to the joint formed if the strips were applied to flattened plastics sheets.

The invention will now be illustrated, having regard to the following drawings illustrating a preferred embodiment of the invention and detailed description thereof.

DETAILED DESCRIPTION OF THE PREFERRED EMBODIMENT THEREOF

Figure 1:
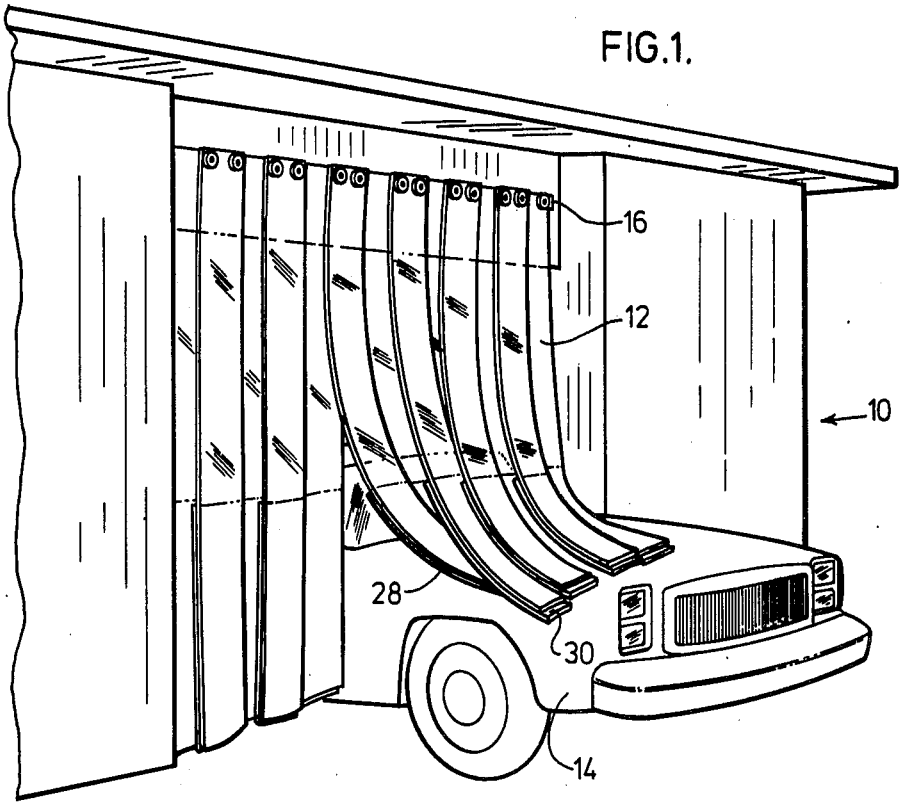
FIG. 1 illustrates a flexible strip door mounted on the exit door of a car wash, according to a preferred embodiment of the invention.
Figure 2:
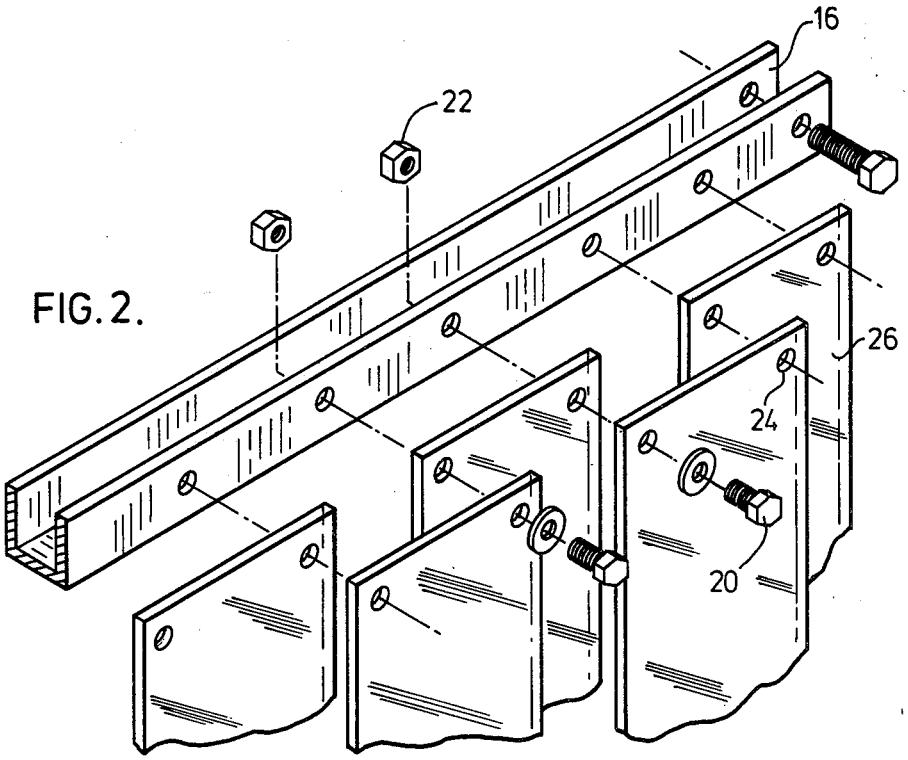
FIG. 2 is a close-up exploded view of part of the structure shown in FIG. 1.

With reference to FIG. 1 there is shown a car wash exit 10, substantially closed by flexible strip door 12, being penetrated by automobile 14. Flexible strip door 12 is hung from U-head channel 16, secured adjacent the top of the exit (shown in FIGS. 2, 3 and 4), by bolts 20 and nuts 22 through apertures 24, in strips 26. Each strip of plastics material manufactured by B. F. Goodrich Limited, (PVC Koroclear (t.m.)) is 12" wide, 120" long, and 0.120" thick, and is able to withstand temperatures of −40° C.

Figure 3:
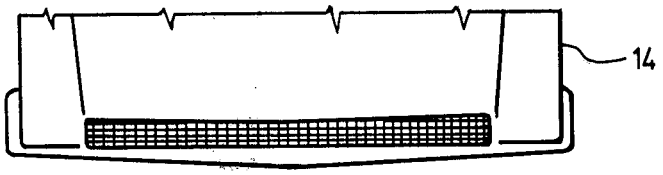
FIG. 3 is a cross-section through part of the embodiment shown in FIG. 1 prior to penetration by the automobile.
Figure 4:
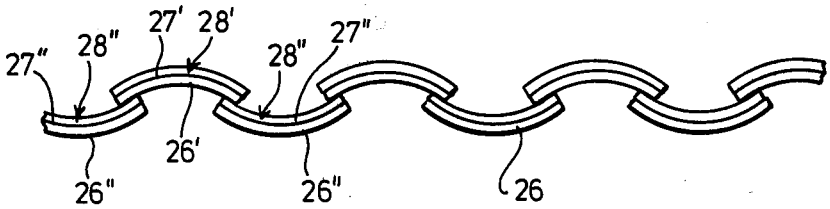
FIG. 4 is a side view of the embodiment shown in FIG. 3.
Figure 4:
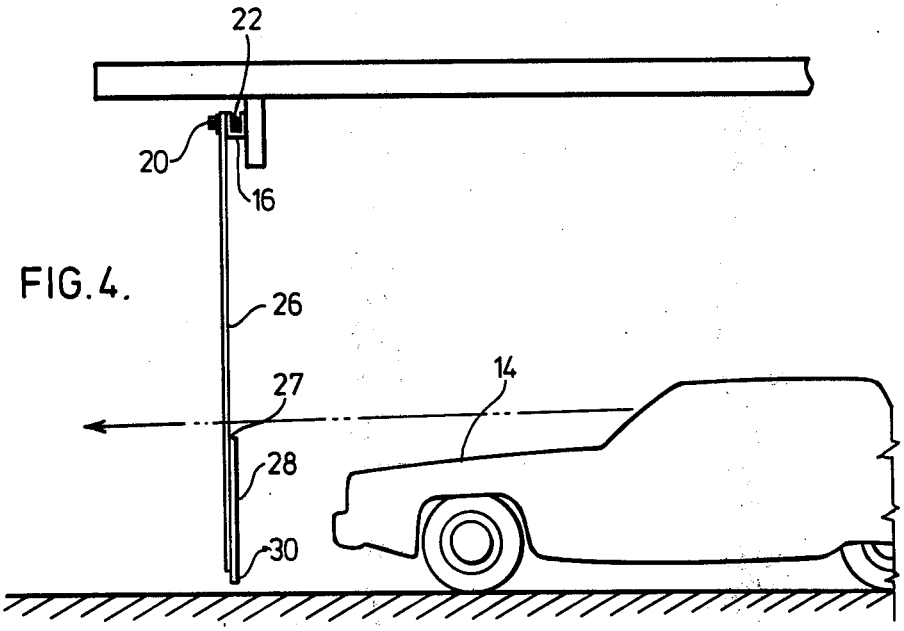

Each sheet 26 has a strip of felt (#718 Felt by Colorelle Limited) 28 glued to the side of the strip 27 facing the interior of the car wash 28. This is best shown in FIGS. 3 and 4. Each strip 26 has a natural curl disposing both a convex and concave side. The sheets are hung alternately so that where one sheet displays a convex side to the interior of the car wash, (see 26' in FIG. 3), adjacent sheets 26" display concave surfaces to the interior of the car wash. As indicated, each sheet 26 bears a felt material glued to the surface facing the interior of the car wash. Therefore, sheet 26' includes a piece of felt 28' glued to the convex surface 27' and sheets 28" are glued to sheets 26" to the concave surfaces 27".

It is noted that because of the natural curl of the sheets 26, where the felt is glued to the convex side, it is wider than the sheet itself and is glued to conform to the curvature of sheet 26'. In the case of the felt being glued to the concave surfaces of the sheets 26" the sheet of felt 28" is of narrower width than the sheet 26 if flattened so as to conform to the concave surface when glued.

Figure 5:
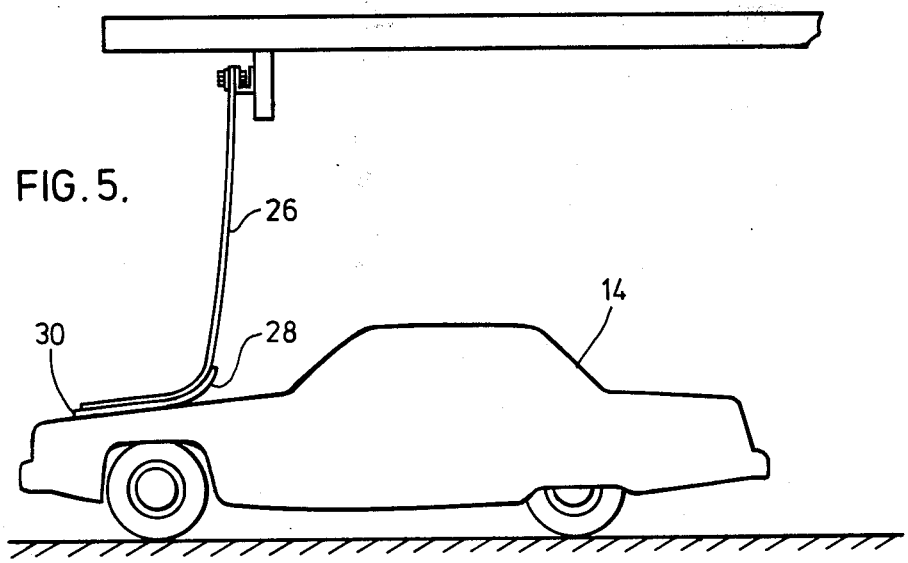
FIG. 5 is a side view of the embodiment in FIG. 1.

The felt material is glued to the strips, to extend below the strips at 30, as shown in FIGS. 4 and 5.

Therefore, in use, the flexible strip door is engaged by a car 14, passing through the exit and strips 26 are pushed ahead and to one side. To prevent obscuring the driver's view when exiting, the felt extends upwardly from the bottom of the plastics sheet only sufficiently to prevent the car from being marred by the plastic, but not so as to obliterate the driver's view in case a vehicle is stopped on the other side of the exit.

Figure 6:
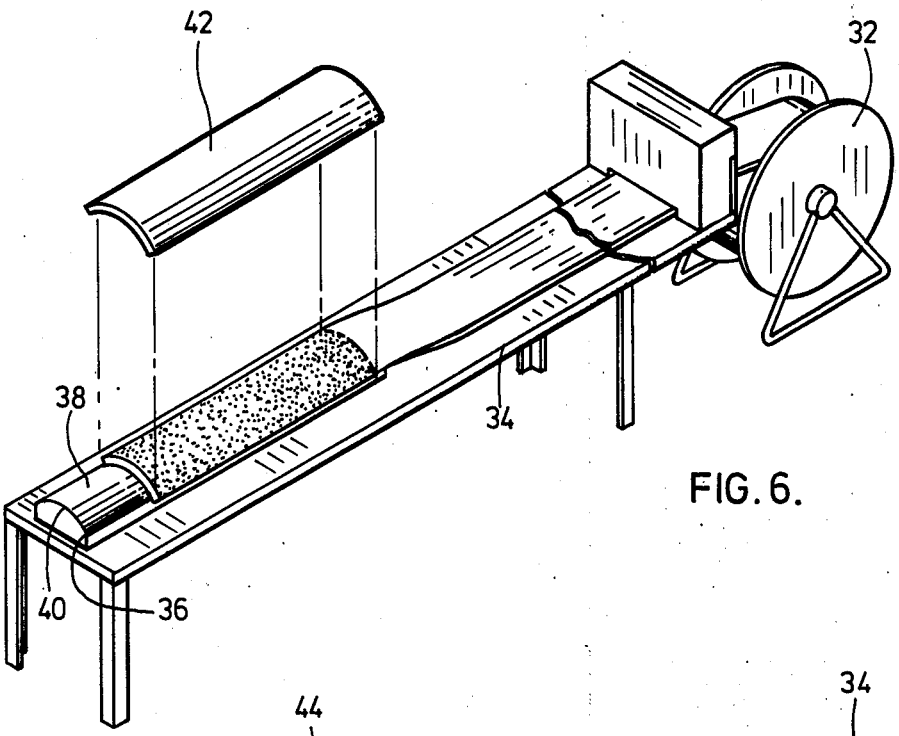
FIGS. 6 and 7 illustrate a method of manufacture of the component strips of the flexible strip door shown in FIG. 1.
Figure 7:
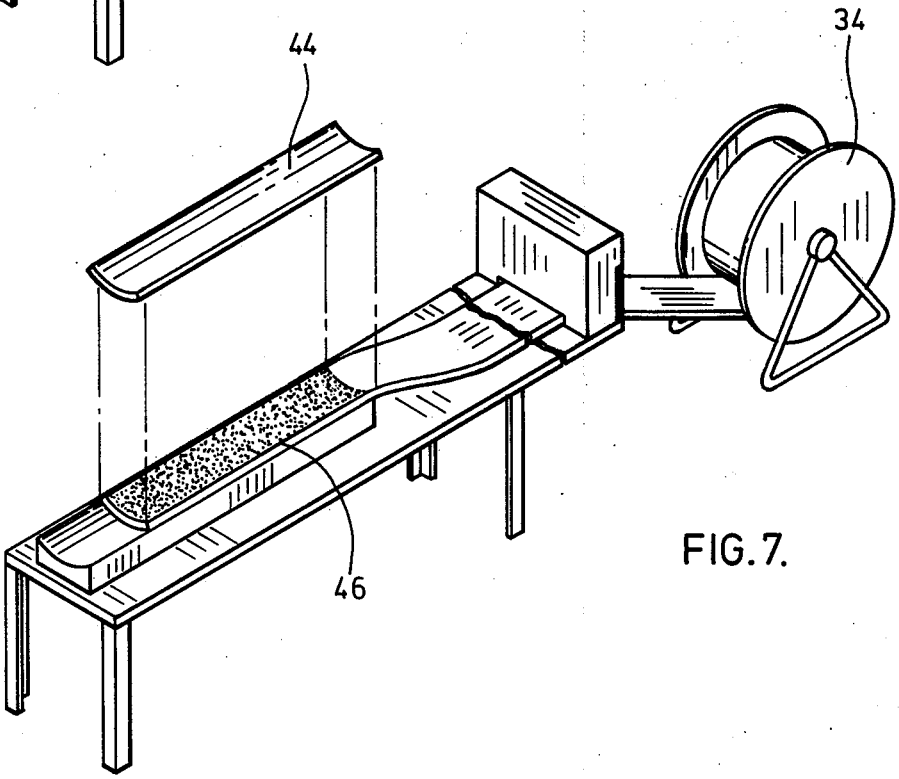

With reference to FIGS. 6 and 7, a method of gluing the felt material to the sheets is shown. In the cases shown, 3 M Glue #EC84 is used to secure the felt to the plastics material.

With reference to FIG. 6, continuous lengths of plastics material are fed from roll 32, onto work bench 34 to lie on curved support 36 having outer convexly curved surface 38 corresponding to the natural curl of the plastics material. The glue is then spread onto the outer convex surface of the plastic sheet and the wider felt strips are secured to the convex surface ensuring that a lower edge 40 a slight portion of the felt extends thereover. Then the sheet is cut from the roll and the next sheet prepared as above. In a similar manner, narrower sheets 44 from roll 34 are secured to the concave surface 46 shown in FIG. 7 and cut.

As many changes could be made to the invention without departing from the scope thereof, it is intended that the description herein be interpreted as illustrative and not in a limiting sense.

The embodiments of the invention in which an exclusive property or privilege is claimed, are as follows:

1. A flexible strip door comprising a plurality of relatively long transparent sheets of heavy gauge plastics material of relatively narrow width as compared to their length, hung in overlapping fashion to close the exit of a car wash, the sheets alternatively displaying concave and convex surfaces to the interior of the car wash, and soft non-abrasive material secured to the inwardly facing concave and convex surfaces from a position intermediate the ends of the sheets to a position below the lowermost edge of each sheet to permit viewing of the driver of a vehicle passing through the car wash through the sheets, but prevent marring the finish to the vehicle passing through.

2. The flexible strip door of claim 1 wherein the soft non-abrasive material is selected from a felt or carpet material, which is glued or sewn to said surfaces.

3. The flexible strip doors of claim 1 or 2, wherein the soft non-abrasive material secured to the concave surface is narrower than the plastics sheet and is secured to the concave surface when the sheet is in its natural curled position and the soft non-abrasive material secured to the convex surface is wider than the plastics sheet and is secured to the convex surface when the sheet is in its natural curled position.

* * * * *